US009175910B2

(12) United States Patent
Wright et al.

(10) Patent No.: US 9,175,910 B2
(45) Date of Patent: Nov. 3, 2015

(54) DEVICES AND METHODS FOR ENHANCING BURDEN UNIFORMITY IN A COMBINATION REFORMING/REDUCING SHAFT FURNACE

(71) Applicants: Travis Wright, Charlotte, NC (US); Steve Montague, Charlotte, NC (US)

(72) Inventors: Travis Wright, Charlotte, NC (US); Steve Montague, Charlotte, NC (US)

(73) Assignee: Midrex Technologies, Inc., Charlotte, NC (US)

( * ) Notice: Subject to any disclaimer, the term of this patent is extended or adjusted under 35 U.S.C. 154(b) by 150 days.

(21) Appl. No.: 14/042,763

(22) Filed: Oct. 1, 2013

(65) Prior Publication Data

US 2014/0091502 A1 Apr. 3, 2014

Related U.S. Application Data

(60) Provisional application No. 61/708,368, filed on Oct. 1, 2012.

(51) Int. Cl.

| | |
|---|---|
| ***C21B 13/00*** | (2006.01) |
| ***F27D 99/00*** | (2010.01) |
| ***C21B 13/02*** | (2006.01) |
| ***F27B 1/00*** | (2006.01) |
| ***F27B 1/10*** | (2006.01) |

(52) U.S. Cl.
CPC ..... *F27D 99/00* (2013.01); *C21B 13/02* (2013.01); *F27B 1/005* (2013.01); *F27B 1/10* (2013.01)

(58) Field of Classification Search
CPC ..... C21B 13/02; F27B 1/10
USPC ..... 266/173, 196; 75/490
See application file for complete search history.

(56) References Cited

U.S. PATENT DOCUMENTS

| | | | | |
|---|---|---|---|---|
| 4,082,543 | A * | 4/1978 | Beggs et al. | 75/10.38 |
| 4,248,623 | A * | 2/1981 | Papst et al. | 75/490 |
| 4,306,903 | A * | 12/1981 | Beggs et al. | 75/10.38 |
| 4,886,097 | A | 12/1989 | Garza-Ondarza | |
| 6,200,363 | B1 | 3/2001 | Whitten, Jr. et al. | |

* cited by examiner

*Primary Examiner* — Scott Kastler
(74) *Attorney, Agent, or Firm* — Clements Bernard PLLC; Christopher L. Bernard; Lawrence A. Baratta, Jr.

(57) ABSTRACT

The present invention provides a combination reforming/reducing shaft furnace for the production of direct reduced iron that utilizes one or more burden uniformity enhancers, such as one or more rotating/reciprocating mixing shafts, one or more stationary flow aids, one or more wall structures/variations, one or more agitators, or the like for ensuring that reforming and reducing in the shaft furnace take place evenly across the width of and throughout the depth of the burden in the shaft furnace.

6 Claims, 1 Drawing Sheet

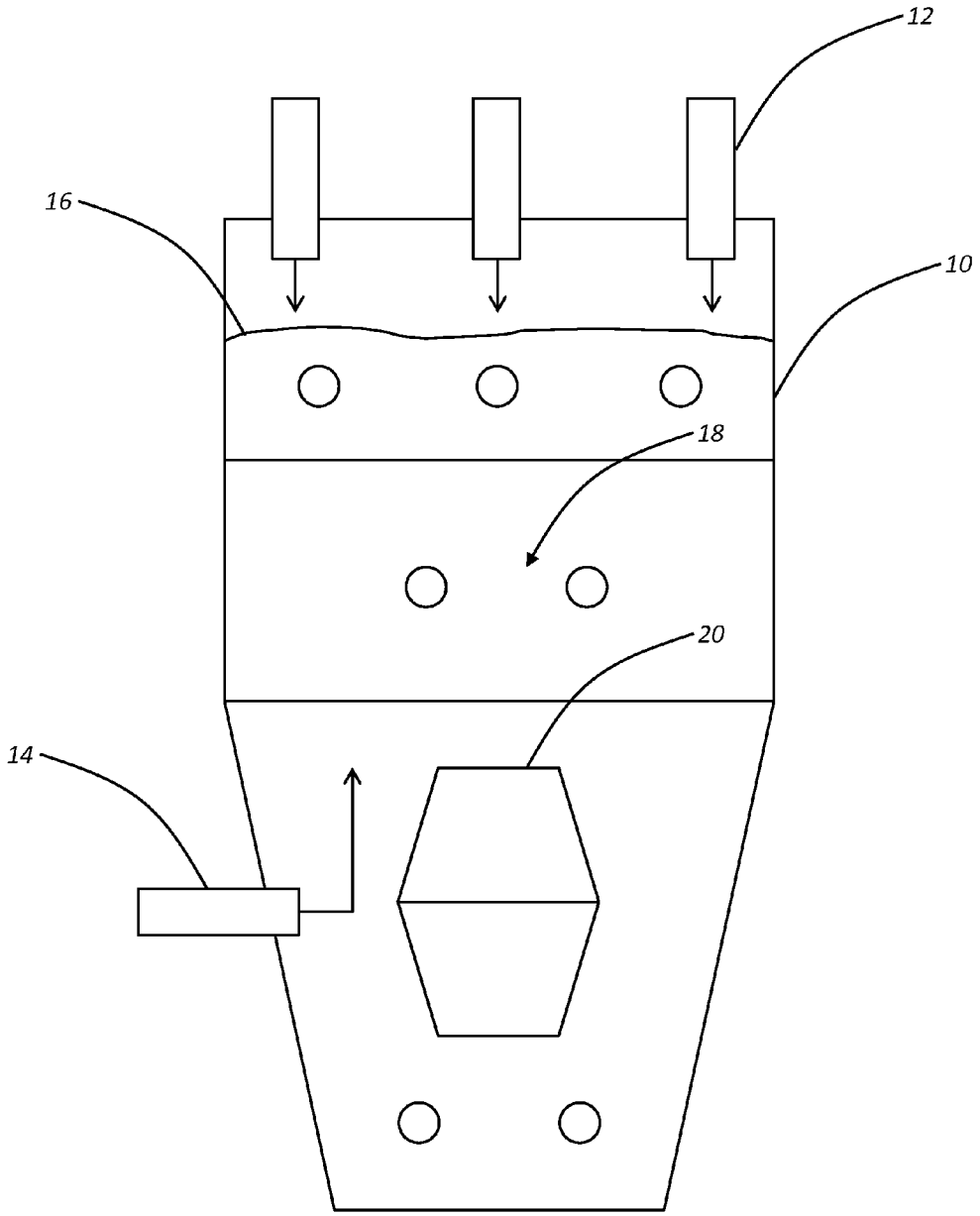
12
16
10
18
20
14

DEVICES AND METHODS FOR ENHANCING BURDEN UNIFORMITY IN A COMBINATION REFORMING/REDUCING SHAFT FURNACE

CROSS-REFERENCE TO RELATED APPLICATION

The present patent application/patent claims the benefit of priority of U.S. Provisional Patent Application No. 61/708,368, filed on Oct. 1, 2012, and entitled "DEVICES AND METHODS FOR ENHANCING BURDEN UNIFORMITY IN A COMBINATION REFORMING/REDUCING SHAFT FURNACE," the contents of which are incorporated in full by reference herein.

FIELD OF THE INVENTION

The present invention relates generally to systems for the direct reduction of iron, such as those utilizing the Midrex or HYL processes or the like. More specifically, the present invention relates to devices and methods for enhancing burden uniformity in a combination reforming/reducing shaft furnace, such as that utilized with no or minimal external reforming of the reducing gas prior to the direct reduction of iron in the shaft furnace.

BACKGROUND OF THE INVENTION

Conventionally, the reducing gas utilized in a shaft furnace for the direct reduction of iron is first reformed outside of the shaft furnace (e.g. in a reformer). More recently, however, there has been a trend towards utilizing a zero reformer, no reformer, or reformerless process that eliminates or substantially reduces the need for external reforming, opting instead for reforming in the shaft furnace itself combined with the direct reduction process. Some amount of external reforming may, however, occur outside of the shaft furnace, but such external reforming is often minimal and only to supplement the need for reforming gas.

One inherent problem with this approach is the inefficiency in creating an even burden uniformity within the shaft furnace or reactor as is created with external reforming, such that reforming is maximized and direct reduction takes place uniformly. Typically, in a shaft furnace, the gravity fed downwards flow of the burden is faster through the center of the shaft furnace than it is along the sides, for example. This results in both undesirable and inconsistent reforming and direct reduction gradients. This problem is compounded as the diameter of the shaft furnace increases.

In conventional direct reduction systems, utilizing an external reformer, unique iron oxide feeding to the top of the shaft furnace, a plurality of rotating mixing shafts or the like, and/or a stationary flow aid are used in the shaft furnace to eliminate undesirable direct reduction gradients, minimize burden clumping, etc., i.e. to promote desirable physical and chemical characteristics. To date, however, such mechanisms have not been used in a zero reformer, no reformer, reformerless, or minimal reformer process in the reforming and/or direct reduction zones. These mechanisms are the subject of the present invention.

BRIEF SUMMARY OF THE INVENTION

In various exemplary embodiments, the present invention provides a combination reforming/reducing shaft furnace for the production of direct reduced iron that utilizes one or more burden uniformity enhancers, such as one or more rotating/reciprocating mixing shafts, one or more stationary flow aids, one or more wall structures/variations, one or more agitators, or the like for ensuring that reforming and reduction in the shaft furnace take place evenly across the width of and throughout the depth of the burden in the shaft furnace. The present invention finds broadest applicability in high pressure (i.e. greater than 5 atm) direct reduction processes, among other applications.

In one exemplary embodiment, the present invention provides a combination high pressure reforming/reducing shaft furnace for the production of direct reduced iron, including: one or more burden uniformity enhancing devices disposed within an interior portion of the shaft furnace; wherein the one or more burden uniformity enhancing devices are disposed within one or more of the reforming zone and the reducing zone within the interior portion of the shaft furnace, and wherein the one or more burden uniformity enhancing devices are operable for churning the burden such that one or more of reforming and reducing take place uniformly throughout the burden. The one or more burden uniformity enhancing devices comprise one or more rotating/reciprocating mixing shafts, one or more stationary flow aids, one or more wall structures, or one or more agitators. The one or more rotating/reciprocating mixing shafts comprise a plurality of protruding structures that, when rotated, mix the burden. Optionally, the one or more rotating/reciprocating mixing shafts span a width of the shaft furnace. The one or more stationary flow aids obstruct the flow of a center portion of the burden through the shaft furnace, thereby slowing it. The one or more burden uniformity enhancing devices ensure that reforming and reducing in the shaft furnace take place evenly across the width of and throughout the depth of the burden in the shaft furnace.

In another exemplary embodiment, the present invention provides a method for providing a combination high pressure reforming/reducing shaft furnace for the production of direct reduced iron, including: providing one or more burden uniformity enhancing devices disposed within an interior portion of the shaft furnace; wherein the one or more burden uniformity enhancing devices are disposed within one or more of the reforming zone and the reducing zone within the interior portion of the shaft furnace, and wherein the one or more burden uniformity enhancing devices are operable for churning the burden such that one or more of reforming and reducing take place uniformly throughout the burden. The one or more burden uniformity enhancing devices comprise one or more rotating/reciprocating mixing shafts, one or more stationary flow aids, one or more wall structures, or one or more agitators. The one or more rotating/reciprocating mixing shafts comprise a plurality of protruding structures that, when rotated, mix the burden. Optionally, the one or more rotating/reciprocating mixing shafts span a width of the shaft furnace. The one or more stationary flow aids obstruct the flow of a center portion of the burden through the shaft furnace, thereby slowing it. The one or more burden uniformity enhancing devices ensure that reforming and reducing in the shaft furnace take place evenly across the width of and throughout the depth of the burden in the shaft furnace.

BRIEF DESCRIPTION OF THE DRAWINGS

The present invention is illustrated and described herein with reference to the various drawings, in which like reference numbers are used to denote like system components/method steps, as appropriate, and in which:

FIG. 1 is a schematic diagram illustrating one exemplary embodiment of the combination reforming/reducing shaft furnace including one or more burden uniformity enhancers of the present invention.

DETAILED DESCRIPTION OF THE INVENTION

Again, in various exemplary embodiments, the present invention provides a combination reforming/reducing shaft furnace for the production of direct reduced iron that utilizes one or more burden uniformity enhancers, such as one or more rotating/reciprocating mixing shafts, one or more stationary flow aids, one or more wall structures/variations, one or more agitators, or the like for ensuring that reforming and reduction in the shaft furnace take place evenly across the width of and throughout the depth of the burden in the shaft furnace.

Referring now specifically to FIG. 1, in one exemplary embodiment, the shaft furnace 10 of the present invention includes a plurality of pellet or agglomerate inlet pipes 12 that selectively introduce iron ore pellets or agglomerates to be directly reduced and one or more bustle gas inlet pipes 14 that selectively introduce a bustle gas to be reformed and directly reduce the iron ore pellets. Such structures are well known to those of ordinary skill in the art. The reducing gas used may be derived from natural gas, coke oven gas, syngas, etc. The iron ore pellets or agglomerates form a bed or burden 16 in the shaft furnace 10. As alluded to above, without the teachings of the present invention, the downwards flow of the burden 16 may be faster through the center of the shaft furnace 10 than it is along the sides, for example, creating large variances in the physical and chemical characteristics of the reducing gas and direct reduced iron.

Preferably, to remedy this problem, the shaft furnace 10 includes one or more rotating/reciprocating mixing shafts 18. These mixing shafts 18 may include, for example, shafts that span all or a portion of the shaft furnace 10 and include a plurality of protruding structures, cams, or the like, all designed to churn the burden 16. The shaft furnace 10 may also include one or more stationary flow aids 20 that support, divert, and control a portion of the burden 16, such that flow in the center thereof is slowed, for example, and, as a result, relative flow at the edges thereof is sped up, for example. These stationary flow aids 20 may be located throughout the shaft furnace 10, or concentrated in a particular portion of the shaft furnace 10. In essence, the stationary flow aids 20 include one or more flow interrupting structures of any desired geometries. The shaft furnace 10 may further include one or more wall structures (not illustrated) that promote the uniformity of the burden 16. For example, wall geometries may be utilized that speed the flow of the burden near the walls, especially when used in conjunction with the stationary flow aids 20. The shaft furnace 10 may still further include one or more agitators (not illustrated) that promote the uniformity of the burden 16 by agitating it and causing churning.

In general, the burden uniformity devices of the present invention ensure that reforming and reduction in the shaft furnace take place evenly across the width of and throughout the depth of the burden 16 in the shaft furnace 10. This is especially important in the reforming and direct reduction zones of the shaft furnace 10, including the upper portion of the shaft furnace 10, the lower portion of the shaft furnace 10, and the transition zone disposed there between.

It should be noted that various references have addressed flow aids and various wall configurations (see e.g. U.S. Pat. Nos. 6,200,363 and 4,886,097), but never in the peculiar context of a high pressure, minimal external reforming, direct reduction system, which brings into play different considerations. As has been noted with regard to conventional direct reduction systems, the problem of achieving a satisfactory flow of particles out of bins, hoppers, silos, and other holding or retaining vessels has been the subject of various studies. Often, when the volume of particles to be handled is large, gravity is relied upon to cause particles to flow out of storage. Although time and money have been spent with varying degrees of success to develop containing vessels for such materials, the problem of whether or not a given solid will flow out of a given container, once it is actually built, still persists.

Whenever a container is designed to have either a mass flow or a funnel flow, numerous factors have to be considered, particularly when test results or experience show that the material to be handled tends to adhere, cake, arch, interlock, or solidify over time. The designer of an efficient storage container must be aware of the problems that can arise both during the storage and during the flow of the solids to be handled. Consequently, the flow properties of the solid to be handled have to be measured to design a suitable container. It is known that the behavior of particulate solids having different flow characteristics is very difficult to predict and many problems arise when such particles are handled within a confining vessel. When such flow properties change, due to changes in temperature, moisture content, etc., provisions have to be made to compensate for such changes in the container structure. Consequently such variations in the flow properties may make the solids flow both complex and critical. An improperly made container will tend to develop a number of unfavorable bulk solids characteristics which impede the flow of particles.

The principal known causes of flow interruptions or stoppages are packing, bridging, and rat-holing phenomena. The origins of such phenomena are not well known or defined. Packing is an inevitable result of a large amount of particles pressing down toward the outlet or outlets of the handling vessel. Bridging or arching occurs when the particles are interlocked and packed by the pressure head from above, forming an arch strong enough to support the entire load of the material in the vessel. Rat-holing occurs when a small cylindrical volume of the material flows down to the outlet, leaving the main body of the material hung up on the wall of the handling vessel.

There are several general approaches employed by those skilled in the art when studying the flowability of particulate solids. These involve the determination of certain parameters of flowability by subjecting a sample of the particles to a shearing action, but prediction of the particle behavior is not always accurate or complete.

Numerous solutions have been proposed and are known from the technical literature. These solutions fall mainly into two classes. First, there are those that relate to the structure of the container itself and that aim to promote a mass flow, a funnel flow, or a combined flow by modifying the physical characteristics of the container, e.g. the type of wall, its shape, the material of which it is made, the use of internal supports, and the nature of its inlets and outlets. T he second class of proposed solutions relate to auxiliary devices or methods for promoting material flow. These may be internal or external and may be mechanical vibrators attached to the container wall, internal slippery liners, agitators, injection of gases to fluidize or otherwise facilitate particle flow, as well as chemicals to aid in solving specific problems.

It has been proposed in the past in order to solve the flow problems in bins and other like vessels to make such containers with very steep wall angles, as well as to avoid any flow obstruction or irregularity in the walls so that the smooth surface prevents stoppages and in some cases to use also some kind of flow aid or promoter.

Such a container or bin constructed for conventional direct reduction use, for example, has a downwardly converging wall from an inlet to an outlet. The container wall is so formed that it comprises an internal contiguous surface with an integral internal inverted spirally shaped or helical continuous step which projects outwardly with respect to the bin. The step provides an enlargement of the cross-sectional area of the bin as defined by the internal edge and also causes an asymmetry of the internal surface of the bin which tends to destabilize the bridges or domes that would otherwise be formed by the cohesive solid particles.

This internal inverted step can be formed from top to bottom of the bin, or in some cases only along a portion of the bin, in particular, in those regions where the internal diameter of the bin causes the solid particles to bridge or dome according to their flow characteristics. The tangential angle which the step makes with the horizontal ranges between about 30 and 40 degrees. Also, the width of the step, i.e. the distance between edges, can be varied and adapted to any particular application depending on the particle sizes, the characteristics of the cohesive particles, and the geometry of the bin. The width of step is greater than the thickness of the sheet metal wall. The container wall in some high temperature uses has an exterior insulation in the form of a wall which is thicker than the step. The angle of convergence may remain the same or may progressively decrease along the spiral step from a steeper angle of the wall above the step to a less steep angle of the wall below the step for any given point along said step. The spiral step encircles the converging wall of the conical container about 1½ times. It is well known in the art that the convergence angle of the bin is selected according to the characteristics of the solid material being handled, the characteristics of the material of the wall, and the type of solids flow desired.

Again, however, this type of configuration does nothing to promote the burden uniformity required in a minimal external reforming direct reduction system, ensuring that both reforming and reduction in the shaft furnace take place evenly across the width of and throughout the depth of the burden 16 in the shaft furnace 10—especially important is the central portion of the burden. This is further especially important in the reforming and direct reduction zones of the shaft furnace 10, including the upper portion of the shaft furnace 10, the lower portion of the shaft furnace 10, and the transition zone disposed there between.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A method for providing a combination high pressure reforming/reducing shaft furnace for the production of direct reduced iron, comprising:

providing a high pressure reforming/reducing shaft furnace operating at 5 atm or greater, wherein an interior portion of the shaft furnace defines a reforming zone and a reducing zone;

providing one or more burden uniformity enhancing devices disposed within the interior portion of the shaft furnace;

wherein the one or more burden uniformity enhancing devices are disposed within one or more of the reforming zone and the reducing zone within the interior portion of the shaft furnace, and wherein the one or more burden uniformity enhancing devices are operable for churning the burden such that one or more of reforming and reducing take place uniformly throughout the burden.

2. The method of claim 1, wherein the one or more burden uniformity enhancing devices comprise one or more rotating/reciprocating mixing shafts, one or more stationary flow aids, one or more wall structures, or one or more agitators.

3. The method of claim 2, wherein the one or more burden uniformity enhancing devices comprise one or more rotating/reciprocating mixing shafts comprising a plurality of protruding structures that, when rotated, mix the burden.

4. The method of claim 3, wherein the one or more rotating/reciprocating mixing shafts span a width of the shaft furnace.

5. The method of claim 2, wherein the one or more stationary flow aids obstruct the flow of a center portion of the burden through the shaft furnace, thereby slowing it.

6. The method of claim 1, wherein the one or more burden uniformity enhancing devices ensure that reforming and reducing in the shaft furnace take place evenly across the width of and throughout the depth of the burden in the shaft furnace.

* * * * *